US007549256B1

(12) United States Patent
Watkins

(10) Patent No.: US 7,549,256 B1
(45) Date of Patent: Jun. 23, 2009

(54) MODULAR WINDOW WELL AND ASSOCIATED ACCESSORIES

(76) Inventor: Donald J. Watkins, 3455 E. Danforth Dr., Salt Lake City, UT (US) 84121

( * ) Notice: Subject to any disclaimer, the term of this patent is extended or adjusted under 35 U.S.C. 154(b) by 250 days.

(21) Appl. No.: 11/400,824

(22) Filed: Apr. 10, 2006

(51) Int. Cl.
*E06B 5/02* (2006.01)

(52) U.S. Cl. ..... 52/107; 52/19; 52/169.7; 182/93

(58) Field of Classification Search ..... 52/107, 52/19, 169.6, 169.7, 309.15; 182/93; 405/284
See application file for complete search history.

(56) References Cited

U.S. PATENT DOCUMENTS

| | | | | | |
|---|---|---|---|---|---|
| 3,046,613 | A * | 7/1962 | Smith | 52/107 |
| 3,786,899 | A * | 1/1974 | Zenhausern | 182/93 |
| 4,704,828 | A * | 11/1987 | Kemp | 52/107 |
| 4,876,833 | A * | 10/1989 | Gefroh et al. | 52/107 |
| 4,896,467 | A * | 1/1990 | McGinnis | 52/107 |
| 5,107,640 | A * | 4/1992 | Gefroh et al. | 52/107 |
| 5,339,579 | A * | 8/1994 | Woodyer et al. | 52/107 |
| D360,699 | S * | 7/1995 | Woodyer et al. | D25/54 |
| D361,630 | S * | 8/1995 | Guernsey | D25/54 |
| 6,367,584 | B1 * | 4/2002 | Edwards | 182/93 |
| D466,221 | S | 11/2002 | Oakley | |
| 6,484,455 | B1 * | 11/2002 | Poole | 52/107 |
| 6,810,629 | B1 * | 11/2004 | Hughes | 52/107 |
| 2003/0182877 | A1 * | 10/2003 | Worth | 52/107 |
| 2004/0098929 | A1 * | 5/2004 | Kim et al. | 52/107 |

* cited by examiner

*Primary Examiner*—Brian E. Glessner
*Assistant Examiner*—James J Buckle, Jr.

(57) ABSTRACT

A window well assembly includes U-shaped walls that have smooth interior and corrugated exterior surfaces, and are formed from polyvinyl material. The walls have coextensive ribs juxtaposed along an exterior surface thereof that are compressible. Each wall has an end wall with an opening formed therein, allowing the ribs to compress and expand. The openings are spaced at opposed ends of selected ribs. A mechanism is included for stacking the walls wherein a top edge of one wall receives a bottom edge of another wall. Ladders are seated against the interior surfaces of the walls. A mechanism is included for snapping the ladders onto the wall interior surface. A safety grill is mounted on top of the second wall, having an outer edge extending along a top edge of the second wall, for prohibiting the user from stepping into a cavity defined between the walls and the foundation window wall.

15 Claims, 7 Drawing Sheets

MODULAR WINDOW WELL AND ASSOCIATED ACCESSORIES

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to window wells and, more particularly, to a modular window well and associated accessories for retaining soil at a window having a sill height lower than an adjacent ground elevation.

2. Prior Art

For many years sub-terrain window systems have been designed to allow light into basement areas in order to make the space more desirable, as well as to meet building code requirements. These window systems generally comprise a standard size or other window located, at least in part, below grade. Provided at the window location is a window well structure surrounding the outside window surface which acts, at least in part, to retain the earth at a predetermined distance away from the outer window surface. Early efforts to accomplish this goal are known in the prior art. Since the earliest applications, many other areaway or window well designs and improvements have been designed and directed to the improvement of window well structure capabilities such as admitting light and retaining earth.

Such applications, however, incorporate window wells and areaways that are generally constructed of a heavy steel material and are formed of large sections. The considerable size of the window wells make them cumbersome to transport, maneuver and install. Such large unitary window wells are also not easily adjustable in height which is not desirable when the windows are located at varying depths with respect to a ground surface. Furthermore, due to the metal composition thereof, early window well designs have a limited lifespan since the structure is vulnerable to oxidative processes, like rust, which greatly reduces the structural rigidity thereof.

Due to a desire to utilize basement windows for a possible escape route during emergencies, and later due to many building codes provisions regarding basement egress, window wells or areaways have been designed to facilitate such an escape in case of an emergency. One prior art example describes an areaway that is an extension of the basement space beyond the foundation wall. This patent disclosure recognizes that a basement window could be useful as a means of escape. More recently, relatively deep window well structures having U-shaped cross-sections and a vertical wall on each of three sides have been developed. It has been recognized as desirable to provide a series of steps or a ladder therein so that an escapee may more easily scale the wall of the window well structure. This has traditionally been accomplished by the use of a separate external ladder that drops into the window well. Such a separate ladder, however, means that the user must expend more funds for the purchase thereof.

Accordingly, a need remains for a modular window well and associated accessories in order to overcome the above-noted shortcomings. The present invention satisfies such a need by providing a modular window well that is easy to install, has superior structural strength, is durable in nature, and is aesthetically pleasing. Both contractors and do-it-yourself enthusiasts can quickly and easily install the light weight, yet highly durable, modular window well sections. The individual sections are easily stackable to a desired height and lock in place to maintain the desired height. After installation, the top of the window well advantageously has a finished and appealing appearance, complimenting the overall appearance of the home, which will never become discolored due to rust.

BRIEF SUMMARY OF THE INVENTION

In view of the foregoing background, it is therefore an object of the present invention to provide a modular window well and associated accessories. These and other objects, features, and advantages of the invention are provided by a stackable Window well assembly for retaining soil at a window has a sill height lower than an adjacent ground elevation.

The window well assembly includes a plurality of U-shaped walls that have smooth interior surfaces and corrugated exterior surfaces respectively. Such U-shaped walls are formed from deformably resilient polyvinyl material such that the exterior surfaces can conveniently be resiliently biased from a vertical plane and thereby effectively be adapted to a stressed position for fitting within confined subterranean regions surrounding the foundation window wall. The U-shaped walls further have a plurality of coextensively shaped and compressible ribs that are equidistantly juxtaposed along an entire surface area of the exterior surfaces respectively. Such ribs are resiliently compressible along a horizontal plane such that the U-shaped walls can advantageously absorb an impact force without dislodging from a stacked position.

Each of the U-shaped walls is provided with an end wall that has an opening formed therein for effectively allowing the ribs to freely compress and expand. Such openings are spaced at opposed ends of selected ones of the ribs respectively. Each of the U-shaped walls preferably has oppositely disposed ends provided with a plurality of apertures for effectively receiving a plurality of fasteners therethrough so that the U-shaped walls can advantageously be securely connected directly to an outer perimeter of the foundation window wall.

A mechanism is included for vertically stacking the U-shaped wall in such a manner that a top edge of a first one of the U-shaped walls directly receives a bottom edge of a second one of the U-shaped walls. Such a vertical stacking mechanism preferably includes a unitary and continuous shoulder monolithically formed with the top edge of the first U-shaped wall. The shoulder protrudes upwardly and outward and further defines an apex extending about an entire perimeter of the first U-shaped wall. A unitary and continuous notch is monolithically formed with the bottom edge of the second U-shaped wall. Such a notch protrudes upwardly and inwardly and further travels along an entire perimeter of the second U-shaped wall. The notch and the shoulder maintain continuous contact along corresponding perimeters of the U-shaped walls and are further oriented along a horizontal plane.

A plurality of ladders are directly seated against the interior surfaces of the U-shaped walls for advantageously and conveniently assisting a user to climb up and over the U-shaped walls during exiting procedures.

A mechanism is included for snapping-on the ladders directly to the interior surfaces of the U-shaped walls such that each of the ladders can conveniently be independently and simultaneously detached from a corresponding one of the U-shaped walls as desired by the user. Such a ladder snap-on mechanism may include a plurality of recessed apertures formed directly in the interior surfaces of the U-shaped walls. The apertures include a plurality of aperture pairs that have a fixed spatial relationship corresponding to a width of the ladders respectively. Such ladders have top and bottom ridges laterally spaced from associated rungs thereof so that the top and bottom ridges become directly nested within associated ones of the aperture pairs respectively. Each ladder is coextensively shaped and conveniently interfittable in alternate ones of the aperture pairs so that the user can advantageously and effectively configure the ladders in alternate patterns and along alternate planes.

A safety grill is directly mounted on top of the second (upper) U-shaped wall. Such a safety grill has an outer edge contiguously extending along a top edge of the second U-shaped wall in such a manner that the user is advantageously and effectively prohibited from stepping downwardly into a cavity defined between the U-shaped walls and the foundation window wall when the safety grill is attached to the second (upper) U-shaped wall. The safety grill may have a U-shaped body directly abutted against the second U-shaped wall. Such a safety grill is spaced above the first U-shaped wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
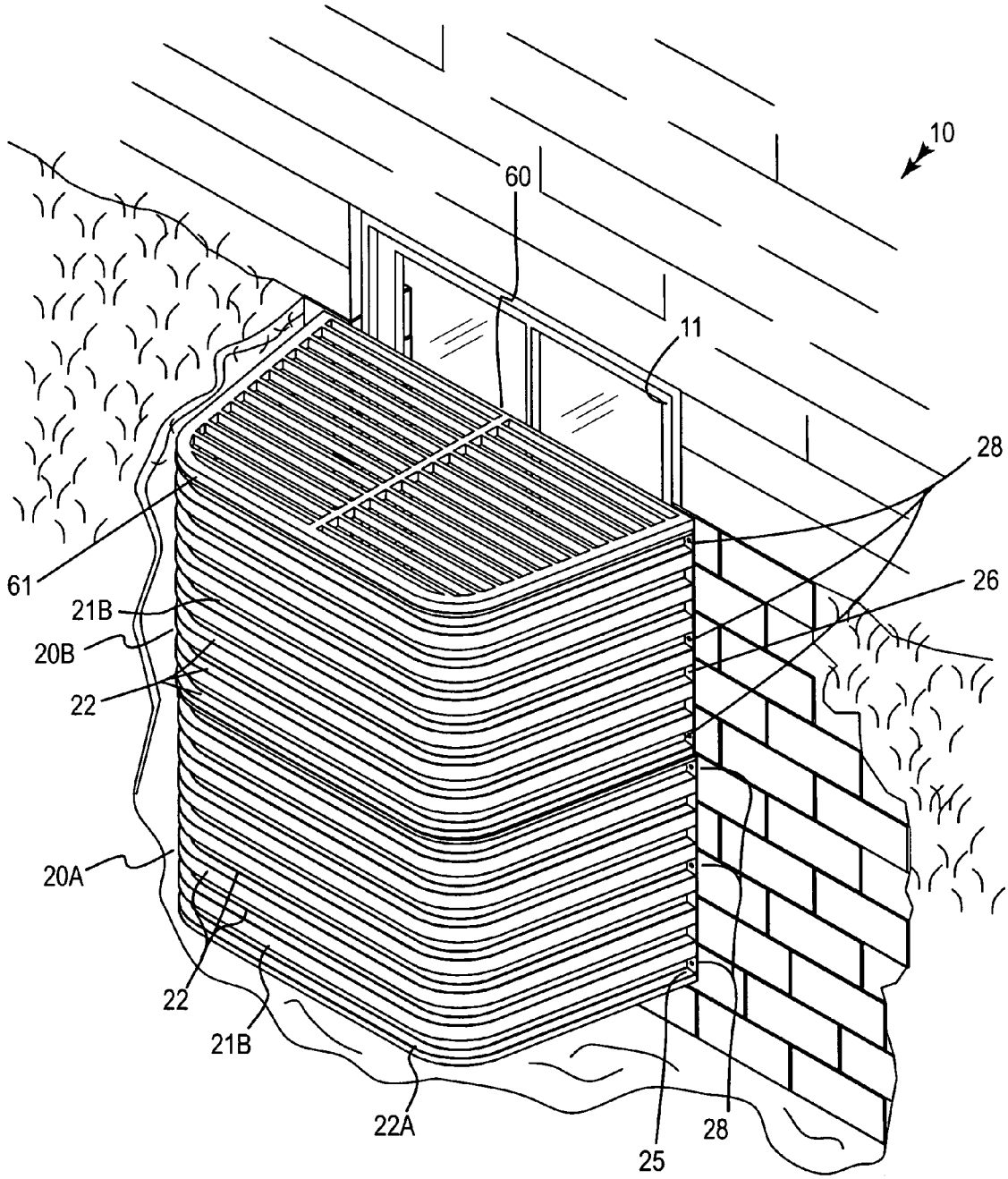
FIG. 1 is a perspective view showing a modular window well assembly and associated accessories, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-10 by the reference numeral 10 and is intended to provide a modular window well and associated accessories. It should be understood that the assembly 10 may be used to protect many different types of windows and should not be limited in use to only protecting basement level windows.

Referring initially to FIGS. 1, 2, 3, 4, 5, 6, 7, 8, 9 and 10, the assembly 10 includes a plurality of U-shaped walls 20 that have smooth interior surfaces 21A and corrugated exterior surfaces 21B respectively. Of course, the U-shaped walls 20 may be produced in a variety of alternate heights and widths depending on the intended application thereof, as is obvious to a person of ordinary skill in the art. Such U-shaped walls 20 are formed from deformably resilient polyvinyl material, which is essential such that the exterior surfaces 21B can conveniently be resiliently biased from a vertical plane and thereby effectively be adapted to a stressed position for fitting within confined subterranean regions surrounding the foundation window wall 11.

Constructing the walls 20 from polyvinyl material is also a crucial feature for advantageously decreasing the weight of assembly 10, making it easier to install, while simultaneously allowing the assembly 10 to be resistant to oxidative processes like rusting, which can weaken the assembly 10 rigidity cause unsightly discoloration. Of course, the U-shaped polyvinyl walls 20 may be produced in a variety of alternate colors for complimenting the color of the building it is employed with, as is obvious to a person of ordinary skill in the art. The U-shaped walls 20 further have a plurality of coextensively shaped and compressible ribs 22 that are equidistantly juxtaposed along an entire surface area of the exterior surfaces 21B respectively. Such ribs 22 are resiliently compressible along a horizontal plane, which is important such that the U-shaped walls 20 can advantageously absorb an impact force without dislodging from a stacked position.

Figure 8:
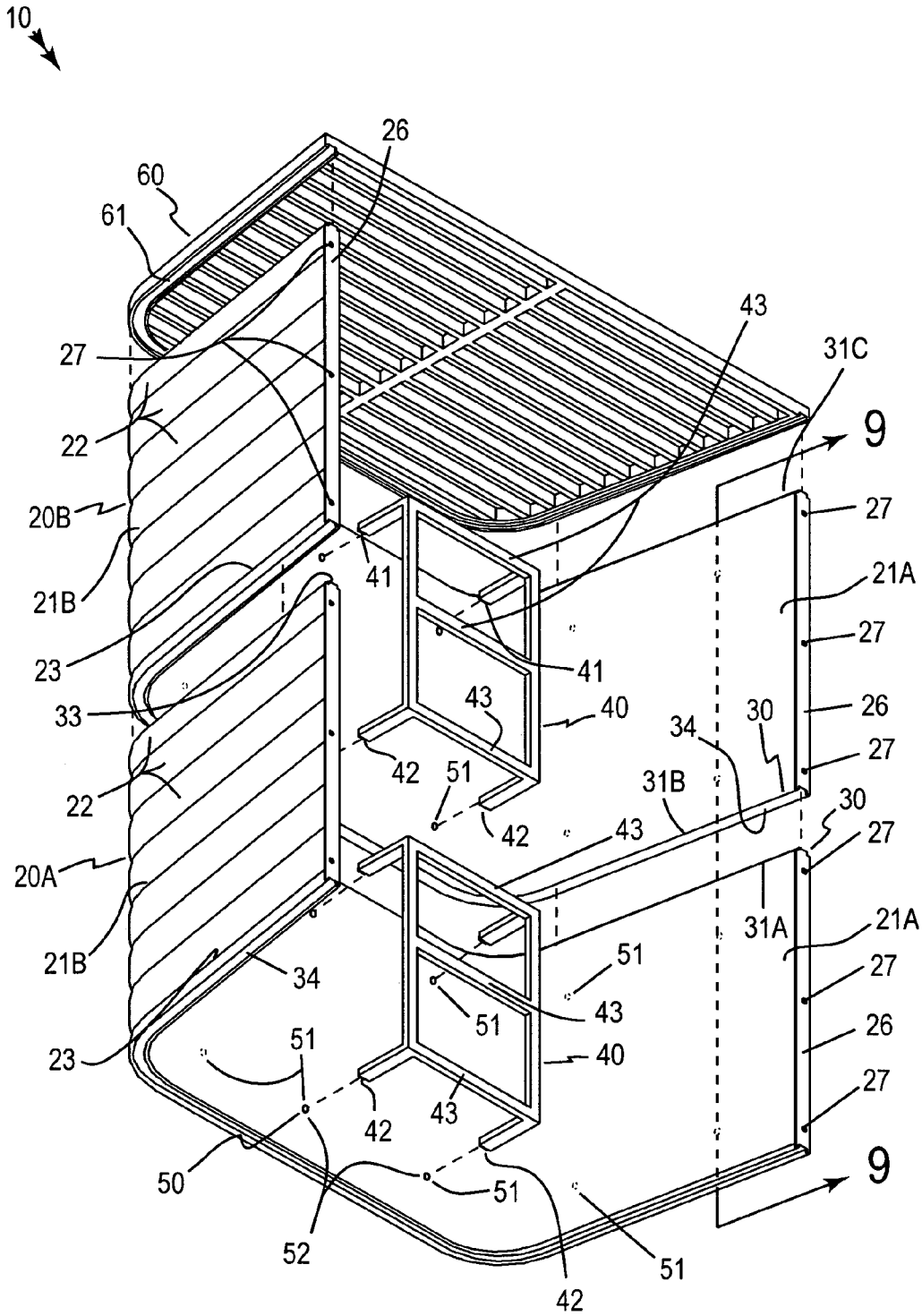
FIG. 8 is an exploded perspective view of the assembly shown in FIG. 1.
Figure 9:
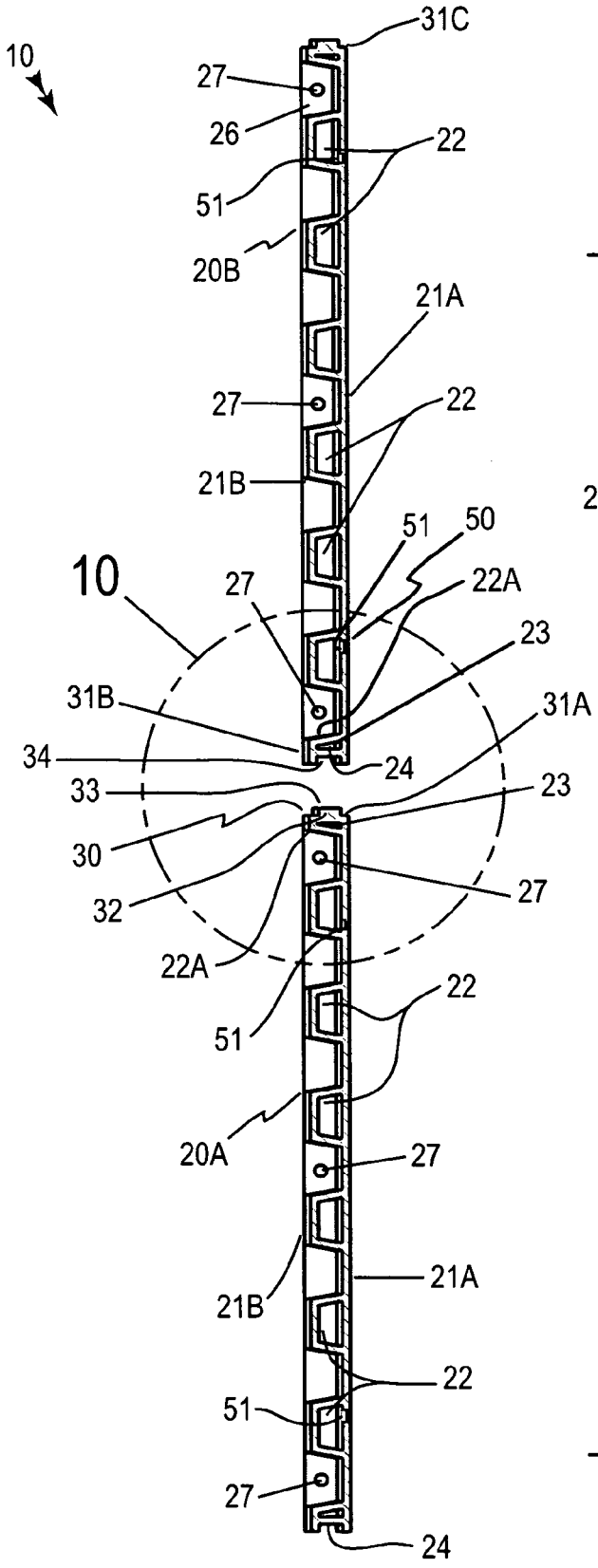
FIG. 9 is a cross-sectional view of the first and second U-shaped walls shown in FIG. 8, taken along line 9-9.
Figure 10:
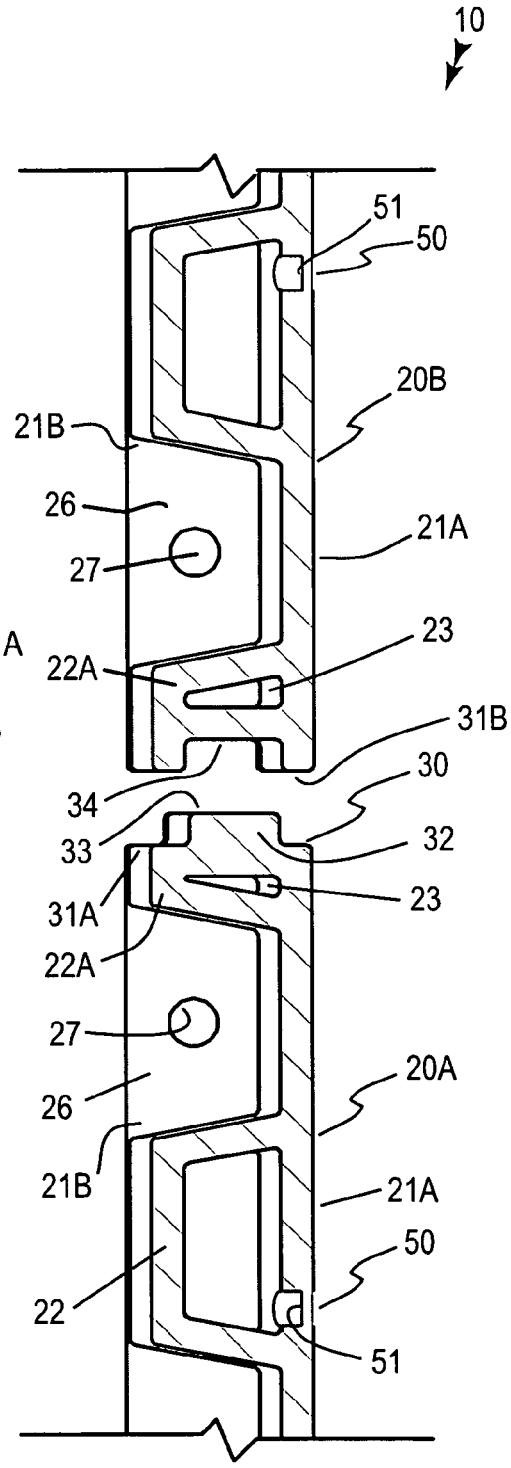
FIG. 10 is an enlarged view of section 10 shown in FIG. 9, showing the snap-on mechanism.

Referring to FIGS. 1, 2, 3, 4, 5, 6, 8, 9 and 10, each of the U-shaped walls 20 is provided with an end wall 23 that has an opening 24 formed therein that is vital for effectively allowing the ribs 22 to freely compress and expand. Such openings 23 are spaced at opposed ends 25 of selected ones 22A of the ribs 22 respectively, as is best shown in FIGS. 9 and 10. Each of the U-shaped walls 20 also has oppositely disposed ends 26 provided with a plurality of apertures 27 that are important for effectively receiving a plurality of fasteners 28 therethrough so that the U-shaped walls 20 can advantageously be securely connected directly, without the use of intervening elements, to an outer perimeter of the foundation window wall 11.

Figure 2:
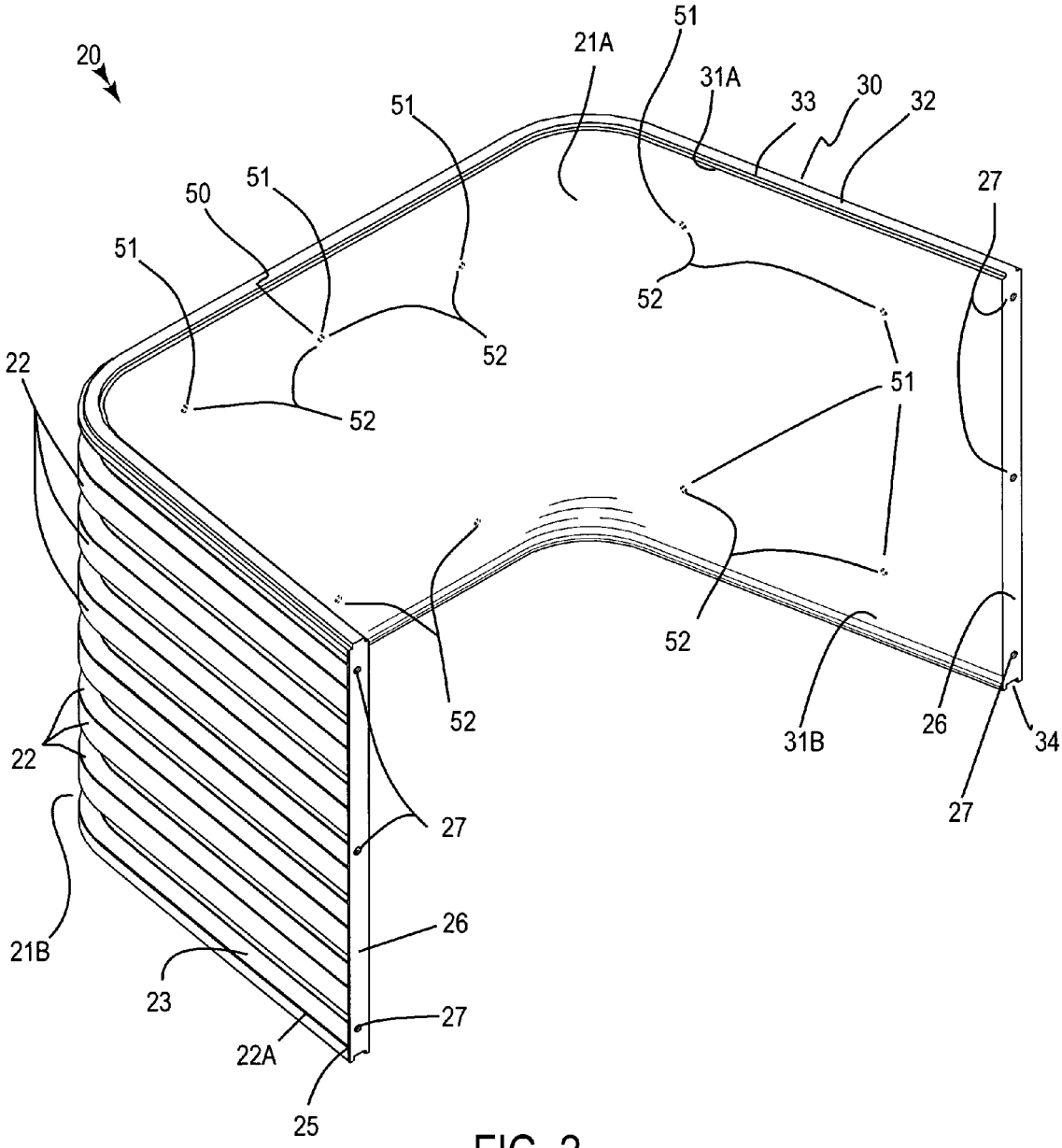
FIG. 2 is a rear perspective view of one U-shaped wall shown in FIG. 1.
Figure 3:
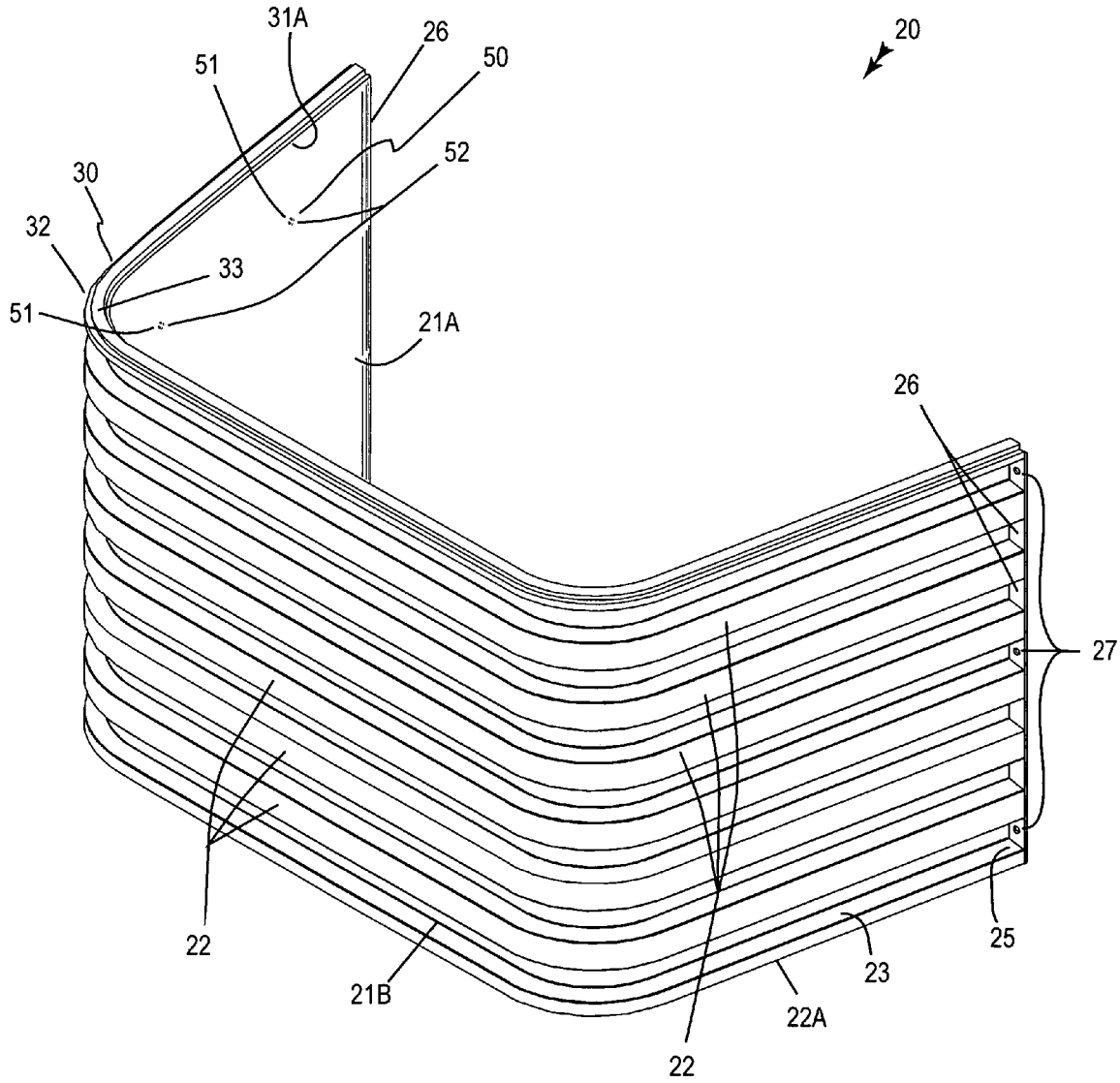
FIG. 3 is a front perspective view of the U-shaped wall shown in FIG. 2.
Figure 4:
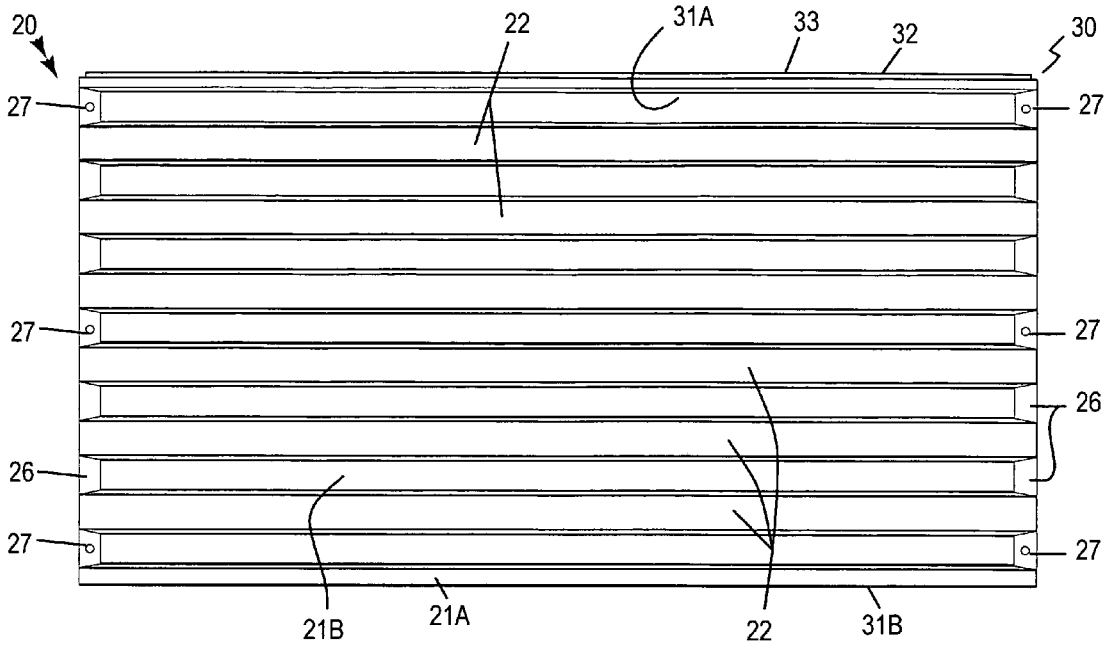
FIG. 4 is a front-elevational view of the U-shaped wall shown in FIG. 3.
Figure 5:
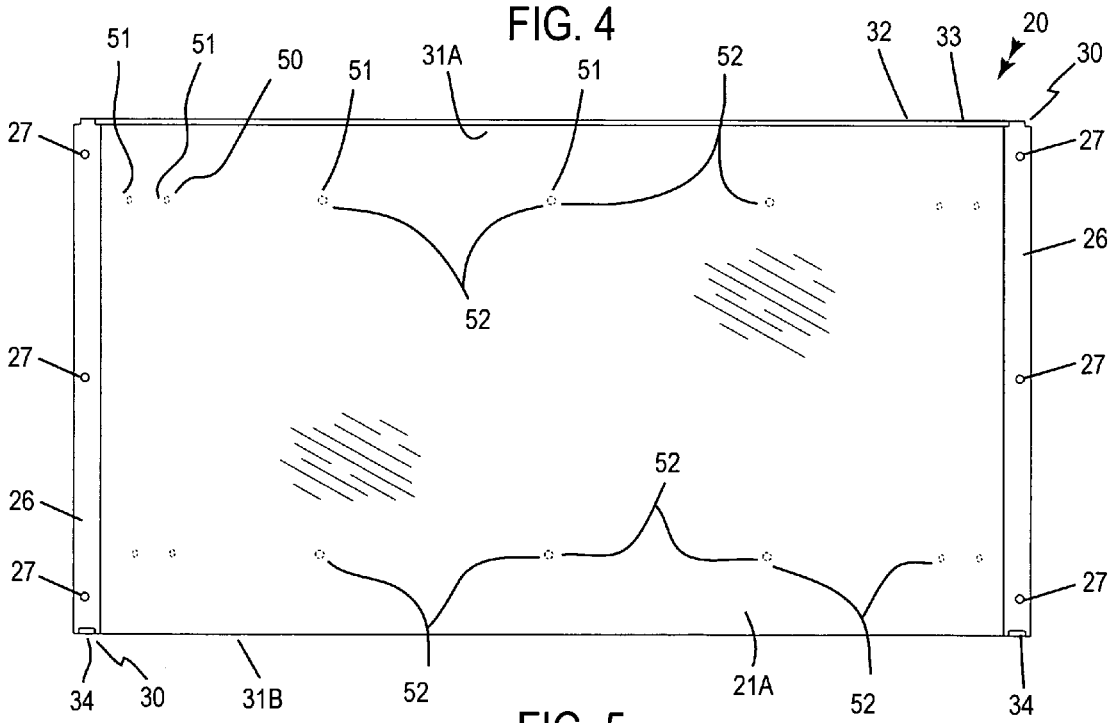
FIG. 5 is a rear-elevational view of the U-shaped wall shown in FIG. 3.

Referring to FIGS. 2 through 10, a mechanism 30 is included for vertically stacking the U-shaped walls 20 in such a manner that a top edge 31A of a first one 20A of the U-shaped walls directly receives, without the use of intervening elements, a bottom edge 31B of a second one 20B of the U-shaped walls. Such a vertical stacking mechanism 30 includes a unitary and continuous shoulder 32 monolithically formed with the top edge 31A of the first U-shaped wall 20A. The shoulder 32 protrudes upwardly and outward and further defines an apex 33 extending about an entire perimeter of the first U-shaped wall 20A, as is best shown in FIGS. 2, 3 and 5.

Figure 6:
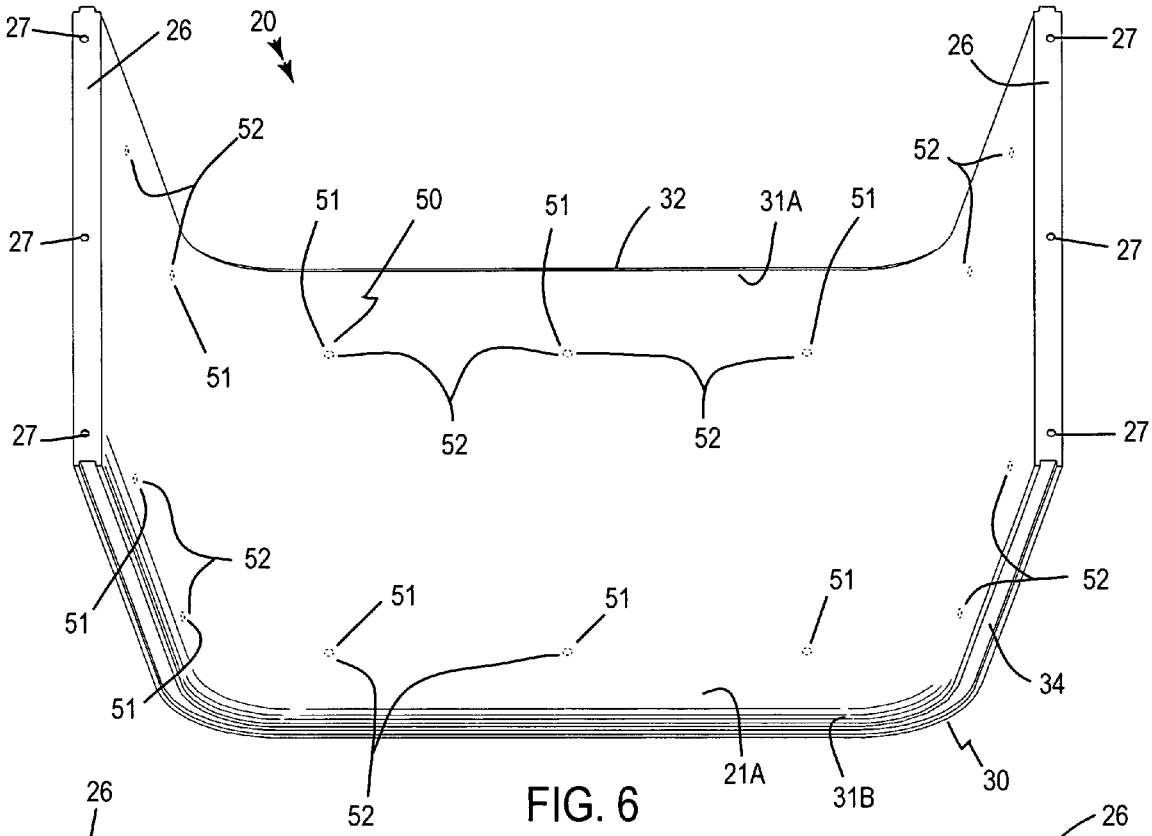
FIG. 6 is a bottom perspective view of the U-shaped wall shown in FIG. 5.
Figure 7:
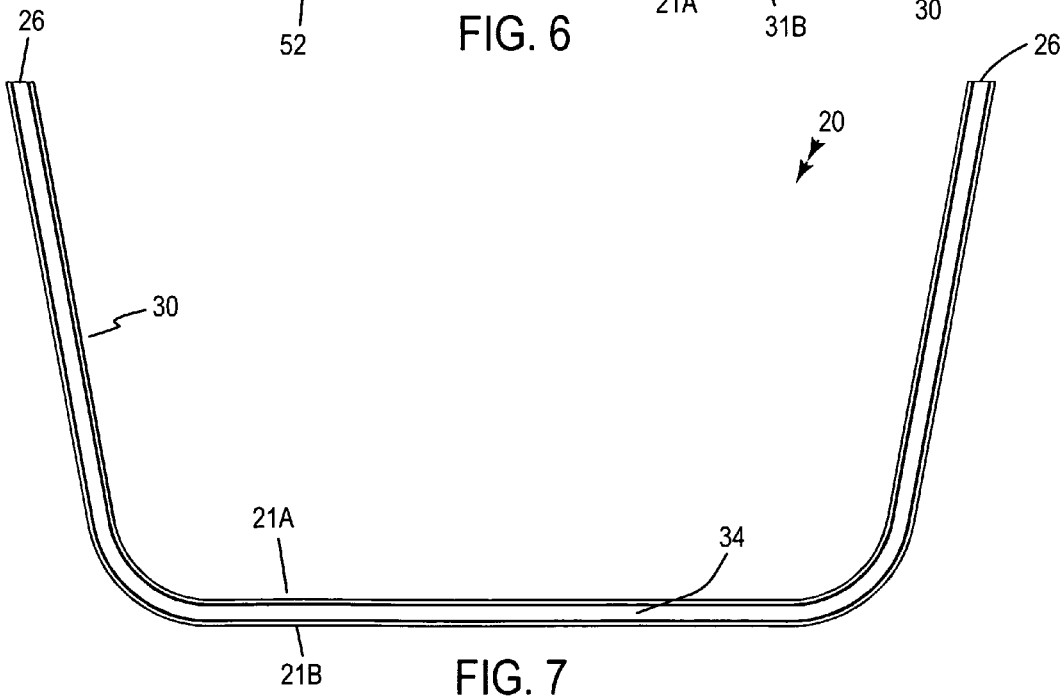
FIG. 7 is a bottom plan view of the U-shaped wall shown in FIG. 5.

A unitary and continuous notch 34 is monolithically formed with the bottom edge 31B of the second U-shaped wall 20B. Such a notch 34 protrudes upwardly and inwardly and further travels along an entire perimeter of the second U-shaped wall 20B, as is best illustrated in FIGS. 6 and 7. The notch 34 and the shoulder 32 maintain continuous contact along corresponding perimeters of the U-shaped walls 20 and are further oriented along a horizontal plane.

Referring to FIG. 8, a plurality of ladders 40 are directly seated, without the use of intervening elements, against the interior surfaces 21A of the U-shaped walls and are crucial for advantageously and conveniently assisting a user to climb up and over the U-shaped walls 20 during exiting procedures. The use of such ladders 40 advantageously eliminates the need for a user to purchase a separate ladder for the purpose mentioned herein above. Furthermore, when purchasing a ladder, a person runs the risk of buying a ladder that may be too tall or too short to be effectively employed with the window well assembly 10. Since the ladders 40 are designed for and sized to be used with the U-shaped walls 20 such an event advantageously will not occur.

Referring to FIGS. 2, 3, 5, 6, 8, 9 and 10, a mechanism 50 is included for snapping-on the ladders 40 directly, without the use of intervening elements, to the interior surfaces 21A of the U-shaped walls 20, which is vital such that each of the ladders 40 can conveniently be independently and simultaneously detached from a corresponding one of the U-shaped walls 20 as desired by the user. This is a critical feature for allowing a user to orient the ladders 40 in such a manner that allows for the easiest and least obstructed egress from the window well assembly 10. Such a ladder snap-on mechanism 50 includes a plurality of recessed apertures 51 formed directly, without the use of intervening elements, in the interior surfaces 21A of the U-shaped walls 20.

Referring to FIGS. 2, 3, 5, 6 and 8, the apertures 51 include a plurality of aperture pairs 52 that have a fixed spatial relationship corresponding to a width of the ladders 40 respectively. Such ladders 40 have top 41 and bottom 42 ridges laterally spaced from associated rungs 43 thereof so that the top 41 and bottom 42 ridges become directly nested, without the use of intervening elements, within associated ones of the aperture pairs 52 respectively. Each ladder 40 is coextensively shaped and conveniently interfittable in alternate ones of the aperture pairs 52, which is important so that the user can advantageously and effectively configure the ladders 40 in alternate patterns and along alternate planes. In particular, the ladders 40 can be removably attached along four different locations extending along a perimeter of the U-shaped walls 20.

Referring to FIGS. 1 and 8, a safety grill 60 is directly mounted, without the use of intervening elements, on top of the second U-shaped wall 20B. Such a safety grill 60 has an outer edge 61 contiguously extending along a top edge 31C of the second U-shaped wall 20B in such a manner that the user is advantageously and effectively prohibited from stepping downwardly into a cavity defined between the U-shaped walls 20 and the foundation window wall 11 when the safety grill 60 is attached to the second U-shaped wall 20B. The safety grill 60 has a U-shaped body directly abutted, without the use of intervening elements, against the second U-shaped wall 20B. Such a safety grill 60 is spaced above the first U-shaped wall 20A. The safety grill 60 also advantageously prevents large pieces of debris from becoming trapped in the cavity formed by the window well assembly 10, which could otherwise interfere with a person's exit from the window well during emergency situations.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. A stackable window well assembly for retaining soil at a window having a sill height lower than an adjacent ground elevation, said window well assembly comprising:

a plurality of U-shaped walls having smooth interior surfaces and corrugated exterior surfaces respectively, wherein said smooth interior surface extends along a vertical plane defined along an entire height of said U-shaped walls respectively, said U-shaped walls being formed from deformably resilient polyvinyl material such that said exterior surfaces can be resiliently biased from the vertical plane and thereby adapted to a stressed position for fitting within confined subterranean regions surrounding the foundation window wall;

means for vertically stacking said U-shaped wall in such a manner that a top edge of a first one of said U-shaped walls directly receives a bottom edge of a second one of said U-shaped walls;

a plurality of ladders directly seated against said interior surfaces of said U-shaped walls for assisting a user to climb up and over said U-shaped walls during exiting procedures;

means for snapping-on said ladders directly to said interior surfaces of said U-shaped walls such that each of said ladders can be independently and simultaneously detached from a corresponding one of said U-shaped walls as desired by the user; and a safety grill directly mounted on top of said second U-shaped wall, said safety grill having an outer edge contiguously extending along a top edge of said second U-shaped wall in such a manner that the user is prohibited from stepping downwardly into a cavity defined between said U-shaped walls and the foundation window wall when said safety grill is attached to said second U-shaped wall.

2. The assembly of claim 1, wherein said vertical stacking means comprises:

a unitary and continuous shoulder monolithically formed with said top edge of said first U-shaped wall, said shoulder protruding upwardly and outward and further defining an apex extending about an entire perimeter of said first U-shaped wall; and a unitary and continuous notch monolithically formed with said bottom edge of said second U-shaped wall, said notch protruding upwardly and inwardly and further traveling along an entire perimeter of said second U-shaped wall;

wherein said notch and said shoulder maintain continuous contact along corresponding perimeters of said U-shaped walls and are further oriented along a horizontal plane.

3. The assembly of claim 1, wherein said ladder snap-on means comprises:

a plurality of recessed apertures formed directly in said interior surfaces of said U-shaped walls, said apertures including a plurality of aperture pairs having a fixed spatial relationship corresponding to a width of said ladders respectively, said ladders having top and bottom ridges laterally spaced from associated rungs thereof so that said top and bottom ridges become directly nested within associated ones of said aperture pairs respectively;

wherein each of said ladders is coextensively shaped and interfittable in alternate ones of said aperture pairs so that the user can configure said ladders in alternate patterns and along alternate planes.

4. The assembly of claim 1, wherein said safety grill has a U-shaped body directly abutted against said second U-shaped wall, said safety grill being spaced above said first U-shaped wall.

5. The assembly of claim 1, wherein each of said U-shaped walls has oppositely disposed ends provided with a plurality of apertures for receiving a plurality of fasteners therethrough so that said U-shaped walls can be securely connected directly to an outer perimeter of the foundation window wall.

6. A stackable window well assembly for retaining soil at a window having a sill height lower than an adjacent ground elevation, said window well assembly comprising:

a plurality of U-shaped walls having smooth interior surfaces and corrugated exterior surfaces respectively, wherein said smooth interior surface extends along a vertical plane defined along an entire height of said U-shaped walls respectively, said U-shaped walls being formed from deformably resilient polyvinyl material such that said exterior surfaces can be resiliently biased from the vertical plane and thereby adapted to a stressed position for fitting within confined subterranean regions surrounding the foundation window wall, wherein said U-shaped walls further have a plurality of coextensively shaped and compressible ribs equidistantly juxtaposed along an entire surface area of said exterior surfaces respectively, said ribs being resiliently compressible along a horizontal plane such that said U-shaped walls can absorb an impact force without dislodging from a stacked position;

means for vertically stacking said U-shaped wall in such a manner that a top edge of a first one of said U-shaped walls directly receives a bottom edge of a second one of said U-shaped walls;

a plurality of ladders directly seated against said interior surfaces of said U-shaped walls for assisting a user to climb up and over said U-shaped walls during exiting procedures;

means for snapping-on said ladders directly to said interior surfaces of said U-shaped walls such that each of said ladders can be independently and simultaneously detached from a corresponding one of said U-shaped walls as desired by the user; and a safety grill directly mounted on top of said second U-shaped wall, said safety grill having an outer edge contiguously extending along a top edge of said second U-shaped wall in such a manner that the user is prohibited from stepping downwardly into a cavity defined between said U-shaped walls and the foundation window wall when said safety grill is attached to said second U-shaped wall.

7. The assembly of claim 6, wherein said vertical stacking means comprises:

a unitary and continuous shoulder monolithically formed with said top edge of said first U-shaped wall, said shoulder protruding upwardly and outward and further defining an apex extending about an entire perimeter of said first U-shaped wall; and a unitary and continuous notch monolithically formed with said bottom edge of said second U-shaped wall, said notch protruding upwardly and inwardly and further traveling along an entire perimeter of said second U-shaped wall;

wherein said notch and said shoulder maintain continuous contact along corresponding perimeters of said U-shaped walls and are further oriented along a horizontal plane.

8. The assembly of claim 6, wherein said ladder snap-on means comprises:

a plurality of recessed apertures formed directly in said interior surfaces of said U-shaped walls, said apertures including a plurality of aperture pairs having a fixed spatial relationship corresponding to a width of said ladders respectively, said ladders having top and bottom ridges laterally spaced from associated rungs thereof so that said top and bottom ridges become directly nested within associated ones of said aperture pairs respectively;

wherein each of said ladders is coextensively shaped and interfittable in alternate ones of said aperture pairs so that the user can configure said ladders in alternate patterns and along alternate planes.

9. The assembly of claim 6, wherein said safety grill has a U-shaped body directly abutted against said second U-shaped wall, said safety grill being spaced above said first U-shaped wall.

10. The assembly of claim 6, wherein each of said U-shaped walls has oppositely disposed ends provided with a plurality of apertures for receiving a plurality of fasteners therethrough so that said U-shaped walls can be securely connected directly to an outer perimeter of the foundation window wall.

11. A stackable window well assembly for retaining soil at a window having a sill height lower than an adjacent ground elevation, said window well assembly comprising:

a plurality of U-shaped walls having smooth interior surfaces and corrugated exterior surfaces respectively, wherein said smooth interior surface extends alone a vertical plane defined along an entire height of said U-shaped walls respectively, said U-shaped walls being formed from deformably resilient polyvinyl material such that said exterior surfaces can be resiliently biased from the vertical plane and thereby adapted to a stressed position for filling within confined subterranean regions surrounding the foundation window wall, wherein said U-shaped walls further have a plurality of coextensively shaped and compressible ribs equidistantly juxtaposed along an entire surface area of said exterior surfaces respectively, said ribs being resiliently compressible along a horizontal plane such that said U-shaped walls can absorb an impact force without dislodging from a stacked position, wherein each of said U-shaped walls is provided with an end wall having an opening formed therein for allowing said ribs to freely compress and expand, said openings being spaced at opposed ends of selected ones of said ribs respectively, wherein each of said U-shaped walls is provided with a linear outer edge extending along the entire height thereof respectively;

means for vertically stacking said U-shaped wall in such a manner that a top edge of a first one of said U-shaped walls directly receives a bottom edge of a second one of said U-shaped walls;

a plurality of ladders directly seated against said interior surfaces of said U-shaped walls for assisting a user to climb up and over said U-shaped walls during exiting procedures;

means for snapping-on said ladders directly to said interior surfaces of said U-shaped walls such that each of said ladders can be independently and simultaneously detached from a corresponding one of said U-shaped walls as desired by the user; and a safety grill directly mounted on top of said second U-shaped wall, said safety grill having an outer edge contiguously extending along a top edge of said second U-shaped wall in such a manner that the user is prohibited from stepping downwardly into a cavity defined between said U-shaped walls and the foundation window wall when said safety grill is attached to said second U-shaped wall.

12. The assembly of claim 11, wherein said vertical stacking means comprises:

a unitary and continuous shoulder monolithically formed with said top edge of said first U-shaped wall, said shoulder protruding upwardly and outward and further defining an apex extending about an entire perimeter of said first U-shaped wall; and a unitary and continuous notch monolithically formed with said bottom edge of said second U-shaped wall, said notch protruding upwardly and inwardly and further traveling along an entire perimeter of said second U-shaped wall;

wherein said notch and said shoulder maintain continuous contact along corresponding perimeters of said U-shaped walls and are further oriented along a horizontal plane.

13. The assembly of claim 11, wherein said ladder snap-on means comprises:

a plurality of recessed apertures formed directly in said interior surfaces of said U-shaped walls, said apertures including a plurality of aperture pairs having a fixed spatial relationship corresponding to a width of said ladders respectively, said ladders having top and bottom ridges laterally spaced from associated rungs thereof so that said top and bottom ridges become directly nested within associated ones of said aperture pairs respectively;

wherein each of said ladders is coextensively shaped and interfittable in alternate ones of said aperture pairs so that the user can configure said ladders in alternate patterns and along alternate planes.

14. The assembly of claim 11, wherein said safety grill has a U-shaped body directly abutted against said second U-shaped wall, said safety grill being spaced above said first U-shaped wall.

15. The assembly of claim 11, wherein each of said U-shaped walls has oppositely disposed ends provided with a plurality of apertures for receiving a plurality of fasteners therethrough so that said U-shaped walls can be securely connected directly to an outer perimeter of the foundation window wall.

* * * * *